United States Patent [19]

De Satnick

[11] 4,372,095

[45] Feb. 8, 1983

[54] TENNIS BALL PRESSURIZER

[76] Inventor: Allen De Satnick, 780 Boylston St., Prudential Ctr., No. 26F, Boston, Mass. 02199

[21] Appl. No.: 660,463

[22] Filed: Feb. 23, 1976

[51] Int. Cl.[3] ..... B65B 31/08

[52] U.S. Cl. ..... 53/79

[58] Field of Search ..... 53/7, 79, 88, 403; 128/2 B, 347; 141/326, 328, 350, 154

[56] References Cited

U.S. PATENT DOCUMENTS

| | | | |
|---|---|---|---|
| 1,248,492 | 12/1917 | Hill | 128/347 |
| 3,470,867 | 10/1969 | Goldsmith | 128/2 B |
| 3,605,721 | 9/1971 | Hallac | 128/2 B |
| 3,699,739 | 10/1972 | Burdwood | 53/7 |
| 4,031,688 | 6/1977 | Wasserman | 53/79 X |

*Primary Examiner*—John Sipos

*Attorney, Agent, or Firm*—Cesari and Mckenna

[57] ABSTRACT

A tennis ball pressurizer having a source of pressurized gas, a regulating valve for controllably releasing the gas and a hollow needle for injecting the gas into the ball. The needle has an internal bevel at one end which cuts a plug from the wall of the ball. The plug seats into the needle and is partially exposed beyond the end of the needle. Gas is released from the pressure source and passes through the needle to enter into the ball through a side vent in the needle. As the needle is withdrawn from the ball after it is repressurized, the plug engages in and seals the puncture hole.

8 Claims, 5 Drawing Figures

TENNIS BALL PRESSURIZER

BACKGROUND OF THE INVENTION

This invention relates to apparatus for repressurizing a tennis ball or other similar elastic sphere. More particularly, this invention relates to a pressurizer which punctures the ball with a hollow needle to inject a pressurizing gas. The needle automatically seals the puncture hole when it is withdrawn.

It is very desirable that the bounce characteristics of a tennis ball be uniform. The uniform bounce is provided by maintaining a constant pressure within the ball. Often, due to leaks in the ball, inadequate initial pressurization or diffusion through the wall of the ball, the pressure within the ball is below a minimum acceptable level, so that the ball is "dead" and unsuitable for play. In many cases, the ball can be restored to a useable condition by repressurizing it.

Several tennis ball repressurizing units are known in the art. Commonly, such devices insert a mixture of an inflating gas and adhesive into the ball through a hollow needle which punctures the wall of the ball. When the needle is withdrawn, the adhesive fills the puncture hole, and allegedly any other hole in the ball, thereby providing a tight seal of the puncture and any other gas leak in the ball. With such devices, however, some gas is likely to escape from the ball when the needle is withdrawn. Also, this sealing operation is not positively effective so that several attempts may be necessary to successfully seal the ball. Such pressurizers may be difficult to operate and require a considerable amount of maintenance to insure proper operation.

Other pressurizers are known which inject gas into the ball and insert a pre-cut plug in the puncture hole to seal it. This approach is time consuming since a separate plug is cut for each injection. Such plugs have a large cross-sectional area and, consequently, can be blown out of the puncture hole by the pressurized gas inside the ball. A further problem is that the plug disturbs the balance of the ball which causes it to wobble in flight.

SUMMARY OF THE INVENTION

It is an object of the present invention to provide a low cost tennis ball pressurizer which is easy to operate.

It is a further object of the invention to provide a tennis ball pressurizer having a needle which punctures the ball and automatically seals the puncture when the needle is withdrawn.

It is a further object of the invention to provide a tennis ball pressurizer which reliably seals the puncture in a manner which does not unbalance the tennis ball.

In accordance with the present invention, I provide a tennis ball pressurizer which includes a source of pressurized gas, a pressurized container, a regulating valve for releasing the gas from the container and a hollow needle connected to the valve for injecting the gas into the ball. The needle is inserted through the wall of the ball and, as it passes through the wall, it cuts a plug therefrom. The plug partially wedges into an internal bevel which is formed at the end of the needle. The regulating valve is then actuated to release gas into the ball through a vent in the side of the needle. Finally, the needle is withdrawn from the tennis ball and, as the tip of the needle passes back through the wall, the plug engages in and seals the puncture hole.

The needle can cut through the wall of the ball to form a cylindrical plug or the needle may be twisted as it cuts through the ball to form a wedged-shaped plug. In either event, the plug wedges in the end of the needle when the needle is inserted into the ball end, when the needle is withdrawn, the plug engages in and effectively seals the puncture hole.

BRIEF DESCRIPTION OF THE DRAWINGS

The foregoing and other objects of the invention will be more readily understood from the following detailed description of the invention when taken in conjunction with the accompanying drawings in which.

DESCRIPTION OF THE PREFERRED EMBODIMENT

Figure 1:
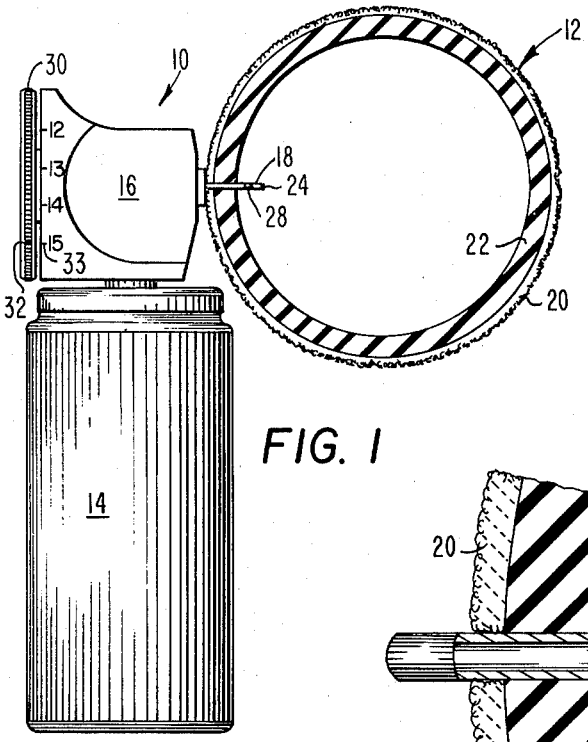
FIG. 1 is a perspective and partial cutaway view of the pressurizer engaging a tennis ball.

A pressurizer in accordance with the present invention is shown generally at 10 in FIG. 1 in use with a tennis ball 12. The pressurizer 10 comprises a pressurized container 14, a pressure regulator 16 and a hollow needle 18.

To use the pressurizer, one forces the needle 18 through the wall of the ball. Thus, the needle 18 cuts through an outer fiber layer 20 and an elastic wall 22 of the ball 12. A plug 24 is thereby cut from the ball 12, and the plug 24 is retained in the end of the needle 18. The pressure regulator 16 is then actuated to release the gas from the container 14. The gas flows through the regulator 16, into the needle 18 and out through a vent 28 in the side of the needle 18. The vent 28 provides an outlet for the gas so that it does not dislodge the plug 24 from the needle 18. The gas in the container 14 is preferably a gas having a large molecular size, such as FREON 12 TM, to reduce the leakage of the gas through the wall 22.

A regulator selector knob 30 is positioned with its index 32 adjacent to a selected one of the pressure markings 33 indicated on the regulator 16. For tennis use, the regulator 16 preferably includes markings for 8 to 16 pounds per sq. inch of pressure. A pressure level is selected to give the ball 12 the desired bounce characteristics.

Figure 2B:
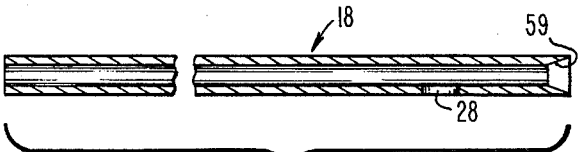
FIG. 2B is a view of the puncture sealing needle of the present invention.
Figure 2A:
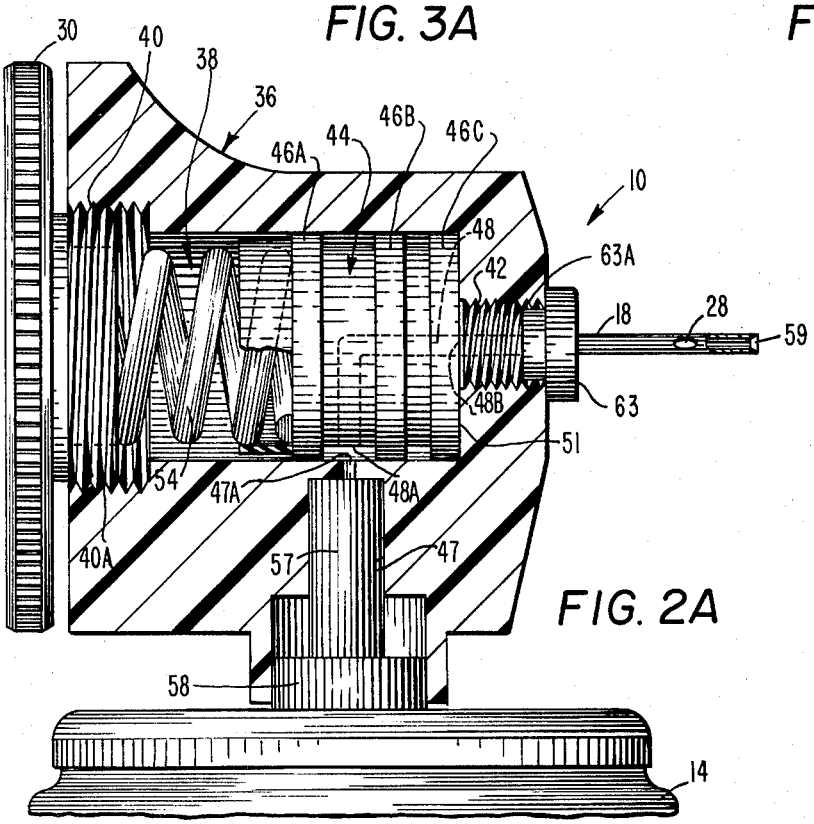
FIG. 2A is a cutaway view of the pressure regulator of the present invention.

The regulator 16 is shown in detail in FIG. 2A. It includes a housing 36 having an interior cylindrical chamber 38 which connects to threaded channels 40 and 42. A piston 44, disposed within the chamber 38, includes three sealing rings 46A–46C which engage the wall of the chamber 38. A channel 48 through the piston 44 connects between an inlet 48A, disposed between rings 46A and 46B, and an outlet 48B in an end 51 of the piston 44 facing the channel 42.

A channel 47, that has an outlet 47A in chamber 38, passes radially through the housing 36 to receive and frictionally engage a valve stem 57 extending from the container 14. The gas container 14 has a conventional valve (not shown) of the type used in small pressured containers such as aerosol cans.

In use, gas is released from the container 14 when the regulator 16 is moved downward to force the valve stem 57 downward. The gas then flows into the chamber 38. The piston 44 is normally forced rightward by a spring 54, with the rings 46A and 46B on either side of the outlet 47A from channel 47. With the rings in this position, the gas enters the inlet 48A in the piston and passes through to the front end 51 of the piston 44 and into the needle 18. The needle 18 in turn, conducts the gas into the tennis ball through the vent 28.

A collar 58 is secured to the top of container 14. The collar 58 is slideable inside channel 47 and engages shoulder 47B in channel 47 to limit the downward travel of regulator 16. The needle is secured to a plug 63 having screw threads 63A which screw into threads 48B of channel 48.

The valve 16 regulates the ball pressure as follows. As the pressure builds up in the tennis ball 12, it pushes against the piston ring 46C, forcing the piston 44 against the spring 54. The piston 44 compresses the spring 54 until the ring 46B moves to the left of the outlet 47A, thereby sealing off the flow of gas through the regulator 16. The rings 46B and 46A seal the inlet 48B to prevent gas from leaking out of the ball 12. It should be noted that the regulator 16 is responsive to the back pressure within the ball. Thus, the ball 12 is inflated to an uniform pressure despite pressure variations inside the container.

The regulator selector knob 30 has a thread 30A which engages thread 40A of channel 40. The spring 54 is compressed between the knob 30 and the piston 44. A regulator cut-off pressure is selected by rotating the knob 30 so that the index 32 is adjacent to the numeral 33 corresponding to the selected pressure. To increase the valve cut-off pressure, the knob 30 is rotated clockwise and is thereby screwed in toward the chamber 38 to compress the spring 54. In this position, an increased pressure inside the ball 12 is required to drive the piston 44 to seal off the gas flow through the regulator 16. Contrarily, to decrease the valve cut-off pressure, the knob 30 is rotated in a counter-clockwise direction.

The puncture sealing needle 18 of the present invention is shown in detail in FIG. 2B. The wall at the end of the needle is formed with an internal bevel 59, the bevel 59 in this case shown to be approximately 30 degrees from the axis of the needle. The needle 18 is preferably made of twenty-one gague metal HYPOTUBE TM.

Figure 3A:
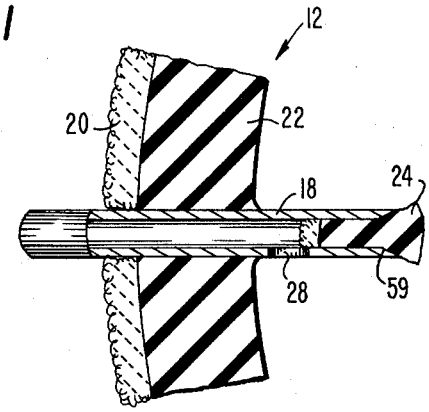
FIG. 3A is a cutaway view of the needle inserted into a tennis ball.
Figure 3B:
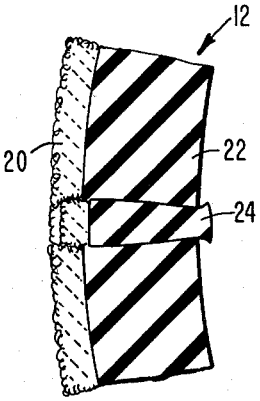
FIG. 3B is a cross-sectional view of the ball with the plug inserted in the ball wall to seal the puncture hole.

The puncture sealing feature of the invention is most readily understood in connection with FIGS. 3A and 3B. In FIG. 3A, the needle 18 is forced through the side wall of the ball 12. The plug 24 is engaged in the beveled end 59 of the needle 18. The needle is inserted into the ball so that the vent 28 is inside the ball 12. The bevel end 59 guides the plug 24 into the needle 18 so that the plug 24 is firmly retained therein and is not dislodged by the flow of gas through the vent 28. The plug 24 partially extends beyond the end of the needle 18.

The needle is withdrawn from the ball after it has been repressurized and, as shown in FIG. 3B, the plug engages the perimeter of the puncture hole such that it remains wedged in the hole. A generally wedge shaped plug 24, as shown in FIGS. 3A and 3B is formed by a twisting motion of the needle 18 as it is pushed through the wall of the ball 12. The needle 18 is forced through wall of the ball 12 without twisting to cut an essentially cylindrical plug 24. The plug seats in the puncture hole slightly off-set toward the center of the ball 12 from the ball surface. Consequently, the fiber layer 20 of the ball closes over the puncture hole which serves to conceal the puncture. Also, the outer end of the off-set, wedge shaped plug 24 has a greater diameter than the portion of the puncture hole wall which it engages, to effect a tight seal of the puncture hole.

It will be clear to those skilled in the art that various changes may be made from the foregoing without departing from the spirit or the scope of the invention being defined with particularity in the attached claims.

I claim:

1. A tennis ball pressurizer comprising a hollow needle head having:

1. an internal bevel at a first end for forming a puncture hole in the tennis ball,
2. A bore portion extending from said first end for accomodating a plug cut from a tennis ball until the needle is removed from the ball,
3. a second end having a fitting for connection to a supply of gas having sufficient pressure for the interior of a tennis ball, and
4. means forming an orifice intermediate said ends, whereby
   (a) when said ball is punctured with said needle to dispose said first end and said orifice within said ball, said needle cuts the plug from the ball as it forms the puncture hole and retains the plug partially exposed beyond said first end, and gas entering said needle through said fitting end is vented into said ball through said orifice and
   (b) when said needle is withdrawn from said ball a partially exposed portion of said plug engages in and seals the puncture hole.

2. A tennis ball pressurizer as defined in claim 1 further including regulating means for terminating the flow of gas into said ball when the pressure inside the ball reaches a predetermined level.

3. A tennis ball pressurizer as defined in claim 2 wherein said regulating means comprises:

A. housing having an internal chamber with inlet means for receiving the pressurized gas and outlet means for releasing the gas into said needle
B. pressure selection means mounted to said housing for generating a reference force proportional to the selected pressure
C. a piston in said housing for receiving at one end the outlet pressure and moveable in response thereto in opposition to the reference force
D. vent means in said piston for conducting the gas from the inlet means to the outlet means
E. sealing means fixed to said piston for sealing the inlet from said vent means when the outlet pressure is at the selected value.

4. A puncture-sealing hollow needle for penetrating an elastic wall of a tennis ball or the like and comprising:

A. a cutting end with an internal bevel for forming a puncture hole by cutting a plug from the wall and retaining the plug partially exposed beyond the cutting end of the needle, whereby the partially exposed portion of the plug engages the wall of the puncture hole, said plug being withdrawn from said needle to seat in the puncture hole when the cutting end is withdrawn from the wall, and
B. means connected to the second end of said needle comprising a fitting for connection to a supply of pressurized gas having sufficient pressure to inflate a tennis ball or the like.

5. A needle as defined in claim 4 further comprising means intermediate said needle ends for venting gas from the needle into said ball after puncturing of said ball with said cutting end and further insertion of said needle so that said venting means is within said ball, so that the pressurized gas received by said needle is released into said ball without dislodging said plug, said venting means insubstantially weakening said needle, whereby said needle can be inserted through said wall in a twisting motion without inelastically deforming said needle.

6. For adjusting the pressure within a hollow article, the combination comprising a needle and means for providing a pressurized gas, said needle having means at one end for cutting a core from the wall of said article, means at said one end for accomodating said cut core, and means at the other end for receiving said pressurized gas whereby the needle holds the core as it is pushed into the article and gas flows into the article while the needle is inserted for pressurizing the article, said accommodating means being configured to retain said core until said needle is withdrawn from said article.

7. A combination in accordance with claim 6 wherein the needle has a bore at the one end for accommodating the core and a beveled edge defining a cutting edge.

8. A combination in accordance with claim 6 wherein the needle has a passage extending along a portion thereof for receiving the gas and an orifice communicating with the passage and extending to the sides of the needle.

* * * * *